US006269733B1

(12) United States Patent
Reust

(10) Patent No.: US 6,269,733 B1
(45) Date of Patent: Aug. 7, 2001

(54) FORCE SERVO ACTUATOR WITH ASYMMETRIC NONLINEAR DIFFERENTIAL HYDRAULIC FORCE FEEDBACK

(76) Inventor: Dennis K. Reust, 2108 N. Benjamin St., Stillwater, OK (US) 74075-2948

( * ) Notice: Subject to any disclaimer, the term of this patent is extended or adjusted under 35 U.S.C. 154(b) by 0 days.

(21) Appl. No.: 09/302,829

(22) Filed: Apr. 30, 1999

(51) Int. Cl.[7] ..... F15B 15/17; F15B 11/10
(52) U.S. Cl. ..... 91/415; 91/433
(58) Field of Search ..... 91/415, 433, 435

(56) References Cited

U.S. PATENT DOCUMENTS

| | | | | |
|---|---|---|---|---|
| 3,053,234 | * | 9/1962 | Chevreux | 91/415 X |
| 3,260,273 | | 7/1966 | Hayner . | |
| 3,479,925 | | 11/1969 | Hayner et al. . | |
| 3,494,257 | | 2/1970 | Welk, Jr. et al. . | |
| 3,555,969 | | 1/1971 | Shah . | |
| 3,555,970 | | 1/1971 | Borgeson et al. . | |
| 3,704,843 | | 12/1972 | Jenny . | |
| 3,955,783 | | 5/1976 | Glaze et al. . | |
| 4,079,906 | | 3/1978 | Durandeau et al. . | |
| 4,372,193 | | 2/1983 | Hall . | |
| 4,537,077 | | 8/1985 | Clark et al. . | |
| 5,074,495 | | 12/1991 | Raymond . | |
| 5,128,908 | | 7/1992 | Reust . | |
| 5,218,820 | * | 6/1993 | Sepehri et al. | 91/435 X |
| 5,230,272 | | 7/1993 | Schmitz . | |
| 5,522,301 | | 6/1996 | Roth et al. . | |
| 5,542,336 | * | 8/1996 | Larkin | 91/415 X |

* cited by examiner

*Primary Examiner*—Hoang Nguyen
(74) *Attorney, Agent, or Firm*—Fellers, Snider, Blankenship, Bailey & Tippens, P.C.

(57) ABSTRACT

A hydraulic force servo system provides apparatus for compensating for unequal loading forces applied to an actuator piston, and for unequal areas on opposite faces of the piston. Asymmetric nonlinear differential hydraulic force feedback from the output side of a force servovalve is summed with the hydraulic control signal inputs to the output stage of the servovalve at hydraulic summing junctions. Impedances offered by orifices in the feedback lines determine the amount of feedback. Nonlinear characteristics of the feedback method serve to compensate for nonlinearities in the servo actuator and system. The impedance ratio of the orifices is selected as a function of the known or postulated asymmetry of the loading forces to be applied to the actuator piston, and the ratio of the areas of the opposing faces of the actuator piston. Hydraulic damping further improves linearity and stability.

10 Claims, 3 Drawing Sheets

FORCE SERVO ACTUATOR WITH ASYMMETRIC NONLINEAR DIFFERENTIAL HYDRAULIC FORCE FEEDBACK

BACKGROUND OF THE INVENTION

1. Field of the Invention

This invention relates generally to servo valves for operating hydraulic actuators, and, more specifically, to using asymmetric nonlinear hydraulic force (pressure) feedback in a servo system that controls a bidirectional hydraulic actuator to compensate for force asymmetries related to the actuator, such as unequal force gain on oppositely directed strokes, unequal loading forces in oppositely directed strokes, or the driving of a nonlinear load.

2. Background

Servo mechanisms are used to move aircraft control surfaces, to position machine tools, to move robotic manipulators, to simulate earthquakes, to test noise, vibration, and harshness characteristics of vehicles, as energy sources for geophysical exploration, to grind eyeglass lenses, to move flight simulator cabins, to provide tactile feedback to joy sticks, to control pavement breaking machines, and for many other applications. Precision servo hydraulic actuators are typically controlled by servovalves. Non-precision actuators are typically controlled by similar but less expensive "proportional" valves. The following discussion will specifically address servovalves, but may apply equally well to proportional valves. Hereinafter, the term "servovalve" should be taken to include the so-called proportional valves.

In a typical form, a servovalve includes a spool valve which receives a flow of fluid from a source through one or more pressurized inlet ports, and whose position along its axis is controlled by variable volumes of fluid in two differential control chambers. These control chambers receive pressurized fluid from a prior stage of the servovalve. A difference in hydraulic force between the two control chambers tends to accelerate the spool toward the chamber with lower hydraulic force. Two differential outlet ports are provided in a four-way valve for delivering pressurized fluid to either one of the opposite chambers of a linear actuator that includes a bidirectional piston mounted in a dual-chamber cylinder. The valve further includes at least one fluid return port that communicates with a fluid reservoir.

A conventional spool valve includes a spool having spaced-apart lands which is mounted for linear motion in opposite directions within a bore in a valve body. With the spool shifted to a first position, one or more pressurized fluid inlet ports are placed into hydraulic communication through a first outlet port with a first chamber of the actuator. Simultaneously, one or more low pressure fluid return ports are placed into hydraulic communication through a second outlet port with the opposite chamber of the actuator, thereby tending to move the actuator piston in one direction to change the position of a load which may be mechanically coupled to the actuator. Commonly, the instantaneous displacements of both the spool and the load are monitored by a Linear Variable Differential Transformer (LVDT) of any well-known type, or a Hall-effect position transducer, or a magnetostrictive transducer.

The actuator piston is urged to move in an opposite direction by shifting the servovalve spool in the opposite direction whereby one or more pressurized fluid inlet ports are placed into hydraulic communication through the second outlet port with the second chamber of the actuator. Simultaneously, one or more low pressure fluid return ports are placed into hydraulic communication through the first outlet port with the first chamber of the actuator, tending to move the actuator piston and connected load in the opposite direction.

The control law used in conventional flow control servovalves is to ideally make hydraulic fluid flow rate proportional to an input signal. The polarity of the input signal determines the direction in which the servovalve spool will move, while the magnitude of the input signal determines the velocity and displacement of spool movement. The magnitude of spool displacement from the center "null" position determines the magnitude of hydraulic fluid flow through the outlet ports. In the ideal case, which ignores flow restrictions and loading effects, flow from the outlet ports is proportional to the input signal.

The servo system may include a single stage wherein the spool valve is mechanically or electrically directly shifted from one position to another to control operation of an actuator. Alternatively, the servo system may employ two stages in which the first stage is a torque motor which in turn controls the positioning of the valve spool of a second stage, which directly controls the actuator. To produce or control large dynamic loads, a third stage of amplification may be added as is well known. Thus in a multistage servovalve, the output stage is driven directly by one or more previous stages.

In hydraulic servo systems, the velocity of the load is a function of the fluid flow rate. By Newton's second law, the actuator applies force to the load and the load applies equal and opposite force to the actuator. The load force may be directly calculated by multiplying the hydraulic pressure on each side of the actuator piston by the piston area exposed to that pressure force, and taking the difference of the two products, i.e., Actuator Force=Load Force=[(Pressure1×Area1)−(Pressure2×Area2)]. For a typical control problem this equation may be simplified to: Hydraulic Force is proportional to [(Pressure1−Pressure2) ×Area Ratio]. This is the differential pressure times the piston area ratio. When the piston area exposed to hydraulic pressure is the same on both sides, the Area Ratio is 1. Otherwise, the potential actuator force is asymmetric, resulting in unequal force gain on oppositely directed strokes.

Since the hydraulic pressure on each side of an actuator piston is in direct fluid communication with its respective output port of a servovalve, actuator pressure may be measured either at the actuator or at the servovalve. The measurement site may be selected for convenience.

In some applications, whether the actuator piston Area Ratio is 1 or another value, force asymmetry might be caused by an asymmetric loading of the actuator. For example, an actuator which is oriented to move in a vertical axis and which supports a heavy load has load asymmetry caused by the force of gravity on the load. The gravitational force on the load increases pressure on the bottom side of the actuator piston in the quiescent state when the load is supported by hydraulic fluid. The quiescent state may be envisioned as a hydraulic lift which supports a load. An illustration of this situation is a machine which supports and shakes an automobile for noise, vibration and harshness (NVH) testing.

In other applications, force asymmetry may occur due to the actuator driving a nonlinear load, such as a linear to rotary translation stage where the mechanical advantage changes with actuator extension, or where the load is a nonlinearly compressible material, such as limestone.

The above described asymmetries tend to cause undesirable nonlinear distortion in an actuator's dynamic output.

They tend to cause significant even-order harmonic distortion, and also odd order harmonic distortion. There is thus a need for a servo control system capable of compensating for force asymmetries related to a force servo actuator. The present invention fills this need through a servovalve with asymmetric nonlinear differential hydraulic force feedback.

3. Discussion of Related Art:

A number of servo systems have been suggested wherein negative pressure feedback is returned from the output of the power stage of a servovalve to an earlier stage.

P.F. Hayner, in U.S. Pat. No. 3,260,273, issued Jul. 12, 1966, entitled Motor Valve having Differential Pressure Feedback, teaches a pressure control hydraulic servovalve wherein a pilot valve positions a control valve member to control the application of fluid under pressure through an outlet in the control valve to provide an output differential pressure across an output actuator device. The differential pressure developed across the output actuator is coupled back to a movable pilot valve member to produce a substantially constant pressure across the actuator device.

U.S. Pat. No. 3,479,925, issued Nov. 25, 1969 to P. F. Hayner and D. G. Eldridge, entitled Hydraulic Signal and Summing System, discloses a pneumatic or hydraulic control system for controlling fluid pressure and flow to an actuator so that the actuator is controlled in accordance with a predetermined function of a plurality of fluid pressure signals. The fluid pressure signals are converted to mechanical forces which are applied to the resilient mechanical structure which directly controls fluid flow from two or more nozzles producing a pressure differential representative of the predetermined function. This pressure differential is employed to meter the fluid pressure and/or flow to the actuator.

U.S. Pat. No. 4,372,193 issued Feb. 8, 1983 to L. R. Hall, entitled System with Constant Force Actuator, teaches a method of maintaining a constant force on an actuator by controlling a pilot differential pressure on the two ends of a pilot operated control valve. The technique passes excess flow to a downstream control valve.

U.S. Pat. No. 4,537,077 issued Aug. 26, 1985 to A. J. Clark and D. N. Maue, entitled Load Dynamics Compensation Circuit for Servohydraulic Control Systems, teaches an electronic compensation circuit which compensates for disturbance factors resulting from forces exerted by a specimen on an actuator. The compensation signal is an anticipatory signal compensating for the load dynamics of a test article on a vibratory test machine.

U.S. Pat. No. 5,128,908 issued Jul. 7, 1992 to D. K. Reust, entitled Pressure Feedback Servovalve for a Seismic Vibrator, teaches a method for reducing harmonic distortion associated with a hydraulic seismic vibrator apparatus using symmetric pressure feedback control. The patent teaches a method for converting the third stage of a three stage servovalve into a pressure control servovalve. The servovalve is converted into a pressure control valve by porting differential negative pressure feedback from the hydraulic output ports of the main stage. The pressure feedback is a differential flow of hydraulic fluid through two passageways based upon the differential pressure applied to the piston of the vibrator actuator. The differential pressure applied to the piston represents the load on the servovalve. The amount of feedback applied is determined by orifices in the feedback passageways. Hydraulic damping of the load is achieved by providing a restricted hydraulic path between the two output ports of the servovalve. The amount of damping is determined by an orifice.

The apparatus of the '908 patent is designed specifically for use on a seismic vibrator as used in geophysical exploration. Although this reference teaches structure for providing differential negative pressure feedback, it does not teach means for accommodating known or postulated force asymmetries related to the load actuator. More specifically, it does not teach or suggest compensating for force asymmetries through orifices having differing impedance characteristics.

U.S. Pat. No. 5,230,272 issued Jul. 27, 1993 to J. Schmitz entitled Hydraulic Positioning Drive with Pressure and Position Feedback Control, discloses a hydraulic drive actuated by a CNC means. The feedback to an electronic servo amplifier may be switched to actuator position or actuator pressure.

U.S. Pat. No. 5,522,301 issued Jun. 4, 1996 to J. E. Roth, et. al. entitled Pressure Control Valve for a Hydraulic Actuator, describes a servovalve assembly for accommodating asymmetrical loading characteristic of unequal area pistons. This patent teaches use of two three-way servovalves, one valve being coupled to the load line of each chamber of the actuator. Asymmetrical actuator loading is compensated for by use of field-replaceable cartridges 82A and 82B characterized by a sleeve portion 220 and a spool 222 (FIGS. 4A, 4B and 6 of the patent). The cartridges are installed in the respective servo valves with the spool portion of the cartridge in engagement with a land on the end of the spool of the servovalve. The differential force applied to the two cartridges multiplied by the ratio of their respective end areas dictates the force applied to the actuator piston. The force is a function of the surface area of one end of the cartridge spool and the pressure in the control passageway. Therefore, by increasing (or decreasing) the diameter of the cartridge spool portion the force applied by the cartridge to the spool and the force on the piston increases (or decreases). (See col. 9, lines 1–21). Restrictions 138A and 138B (FIG. 4A) provide damping.

Notwithstanding the related art, there remains a need for a means to compensate for asymmetrical actuator loading forces which is applicable to any type of hydraulic servo control system having one or more stages of amplification. It is further desirable to avoid the complex extraneous plumbing that characterizes most prior systems.

SUMMARY OF THE INVENTION

The hydraulic servo control system of this invention acts on an actuator piston which is subject to force asymmetries and which is mounted in a dual-chamber cylinder for bi-directionally moving a load in oppositely-directed strokes. The servo control system includes a spool valve of the type wherein its position along its axis is controlled by volumes of fluid in two opposed control signal input ports. The spool valve has at least one inlet port for receiving a flow of pressurized fluid, at least one return port, and at least one outlet port for delivering pressurized fluid to the actuator cylinder. A manifold is operatively connected to a traditional hydraulic flow control servovalve, which controls what would typically have been a displacement servo or velocity servo actuator, so as to change it into a force servo actuator. The servo control system further includes hydraulic means for compensating for any known or postulated force asymmetry related to the actuator. The hydraulic means is characterized by fluid passageways for providing negative nonlinear hydraulic force feedback communication between the outlet ports and control signal input ports and orifices in the fluid passageways having preselected but unequal hydraulic force feedback impedances. The impedance values are preselected as a function of the known or postulated force asymmetry.

In a preferred embodiment of the invention, the servovalve controls fluid flow to the dual-chamber force servo actuator cylinder, and includes a first and a second hydraulic control-signal input port to the final stage, a high pressure port and at least one return port. The servovalve further includes first and second fluid outlet ports in fluid communication with the respective actuator cylinder chambers for applying hydraulic fluid under pressure to the opposite faces of the actuator piston during alternate cycles.

Still with respect to the preferred embodiment, the servo control system is provided with hydraulic means for compensating for known or postulated force asymmetries. A first fluid passageway provides hydraulic force feedback communication between the first outlet port and the second input port. A second fluid passageway provides hydraulic force feedback communication between the second outlet port and the first input port. A first orifice in the first fluid passageway provides a first preselected force feedback impedance, while a second orifice in the second fluid passageway provides a second preselected force feedback impedance. The impedance values are unequal and are derived as a function of the force asymmetry related to the actuator.

In connection with one aspect of the invention, the force asymmetry arises from a difference in the exposed areas on the opposite faces of the actuator piston. In this circumstance, the preselected impedance values are a function of the ratio of the areas of the exposed surface areas of the opposite faces of the actuator piston. The orifice in fluid communication with the chamber having the piston face with the higher exposed surface area will generally have a preselected hydraulic force feedback impedance value less than that of the other orifice.

In connection with another aspect of the invention, the force asymmetry arises from an asymmetric loading of the actuator. In this circumstance the preselected hydraulic force feedback impedance values are a function of the ratio of load forces applied to the opposite faces of the actuator piston during the oppositely directed strokes.

In connection with still another aspect of the invention, the force asymmetry arises from the driving of a nonlinear load, wherein the preselected hydraulic force feedback impedance values are a function of the changing load forces.

The invention improves the fidelity and accuracy of the load actuator's dynamic output and reduces the nonlinear harmonic distortion associated therewith by providing asymmetric nonlinear differential hydraulic force feedback between the outlet ports and control signal input ports.

A better understanding of the present invention, its several aspects, and its objects and advantages will become apparent to those skilled in the art from the following detailed description, taken in conjunction with the attached drawings, wherein there is shown and described the preferred embodiment of the invention, simply by way of illustration of the best mode contemplated for carrying out the invention.

DETAILED DESCRIPTION OF THE PREFERRED EMBODIMENT

Figure 1:
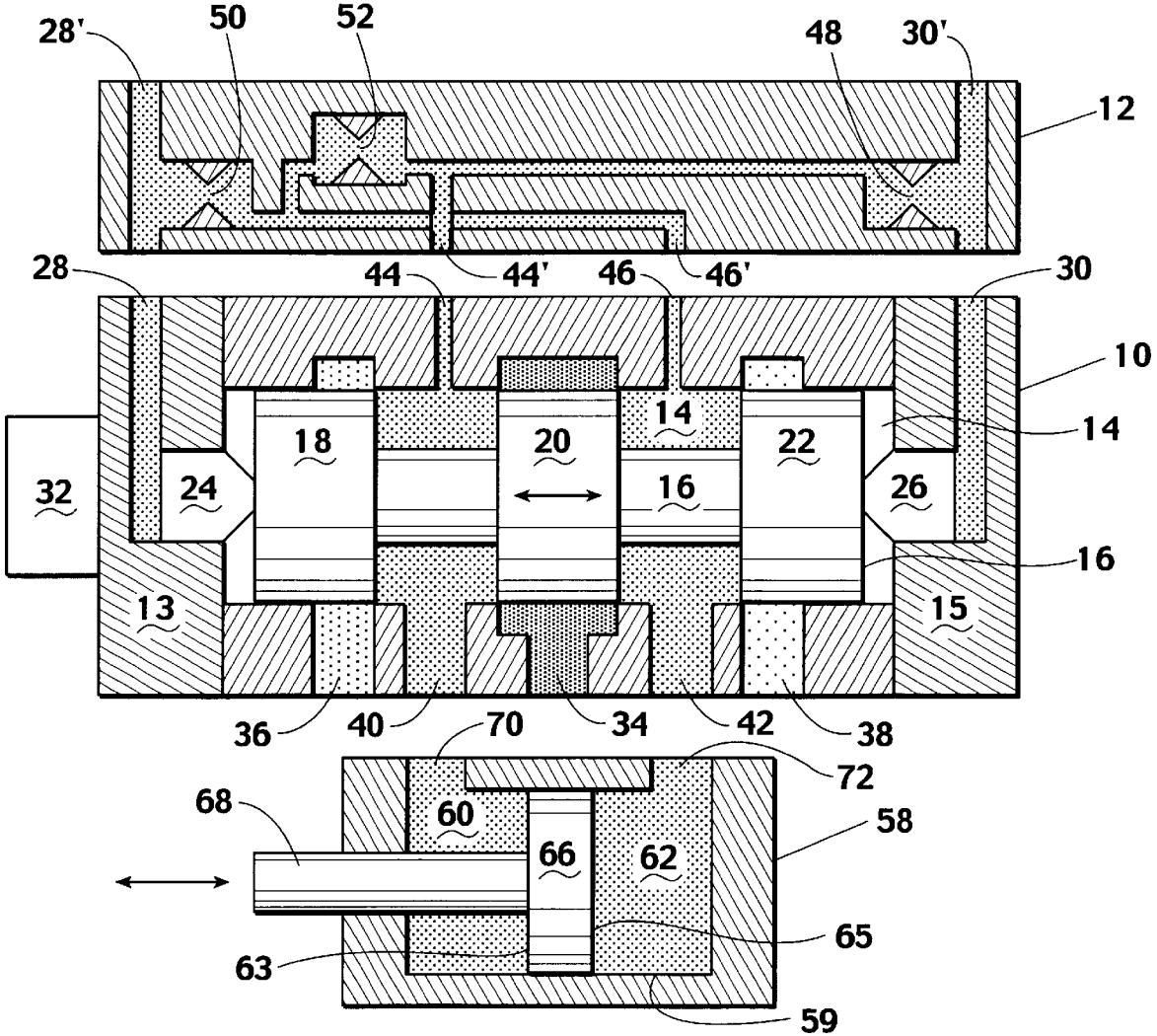
FIG. 1 is a schematic showing of a hydraulic servo control system including a manifold and the final stage of a multistage four-way servovalve having the capability of providing asymmetric nonlinear differential hydraulic force feedback in accordance with the preferred embodiment of the present invention.

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation. Referring now to the drawings, wherein like reference numerals designate identical or corresponding parts throughout the several views, and with particular reference to FIG. 1, there is shown an exploded schematic view of a servo system including a conventional flow control servovalve body, generally shown as 10 (with added force sensing ports 44 and 46), which may constitute the main stage of a multistage servovalve. A manifold 12 provides plumbing and provision for orifices required for converting the valve from flow control configuration to an asymmetric nonlinear differential hydraulic force feedback configuration in line with the teachings of the present invention.

Valve body 10 includes a longitudinal bore 14 that is closed at each end by end caps 13 and 15. A spool 16 having lands 18, 20, and 22 is mounted for linear motion within bore 14 when urged by one of the two optional pressure-actuated equal area stub shafts 24 or 26 that are mounted in the respective end caps 13 and 15. Spool 16 is shown in the neutral or "null" position with all pressure and return ports blocked. When the hydraulic force applied to one stub shaft 24 or 26 through its respective control port (28 and 30) from a control means (not shown) exceeds the force applied to the other stub shaft, the spool 16 is urged to move toward the stub shaft with less control force. The position of the spool 16 is sensed by a displacement transducer 32 of any desired type as earlier mentioned.

Valve body 10 includes a central high pressure port 34 that is coupled to a source of pressurized fluid (not shown) and two laterally bifurcated return ports 36 and 38 that may be connected in parallel to a fluid reservoir of any conventional type (not shown). The return ports may, of course, also be internally connected so that only a single return port penetrates the valve body.

The fluid flow from the valve body 10 acts upon a force servo actuator, generally shown as 58. Force servo actuator 58, which is shown as a linear actuator but which may be rotary, consists of a cylindrical body 59 in which is slidingly mounted a piston 66 and piston rod 68 that may be coupled to a desired load (not shown). Piston 66 separates the cylinder 59 into dual chambers 60 and 62. Outlet ports 40 and 42 of servovalve 10 fluidly communicate with chambers 60 and 62 via actuator ports 70 and 72 respectively. Because of the presence of a single piston rod, the opposing faces of piston 66 have unequal areas.

Sensing ports 44 and 46 in valve body 10 provide samples of the pressures applied to the opposing sides of the actuator piston. As previously stated, manifold 12, which includes first and second control signal input ports 28' and 30' and fluid passageways 44' and 46', is operatively coupled to valve body 10 so that the complementary ports and passageways are aligned for fluid communication as indicated.

A first fluid passageway 44' in manifold 12 provides negative hydraulic force feedback communication between first outlet port 40 and second control signal input port 30–30'. A second fluid passageway 46' provides negative hydraulic force feedback communication between second outlet port 42 and first control signal input ports 28–28'. The fluid passageways thus provide an algebraic summing junction for the control signal and the output sensing signals. The negative feedback provides a restoring force to the servovalve spool in opposition to the urging of the control signal input force against the opposing fixed area stub shafts 24, 26.

Valve body 10 may be of any well-known commercial design for the final stage of a multistage servovalve. Manifold 12 is configured to match the physical design features of the valve with which it will be used.

A first orifice 48, mounted in first fluid passageway 44' of manifold 12, offers a first preselected negative hydraulic force feedback impedance, whereas a second orifice 50 mounted in second fluid passageway 46' offers a second negative hydraulic force feedback impedance. For purposes of the present invention, the impedance values for the first and second orifices 48, 50 are unequal and are selected as a function of the force asymmetry related to the force servo actuator. The present invention thus compensates for a force asymmetry by providing asymmetric nonlinear differential hydraulic force feedback between the outlet ports 40, 42 of the servovalve 10 and the control signal input ports 28, 30. A better understanding of the invention will become apparent from the specific examples given below.

EXAMPLE 1

The force asymmetry may be caused by a difference in the exposed surface areas of an actuator piston. With reference to FIG. 1, the piston 66 has two opposed piston faces 63, 65 of different exposed surface areas due to the presence of piston rod 68. Accordingly, face 63 has a smaller surface area than face 65. If the high pressure port 34 provides equal pressure to both chambers 60, 62 of the actuator cylinder 59 during opposing strokes, unequal force gain is realized on oppositely directed strokes. The potential actuator force is greater on the extension stroke versus the retraction stroke, resulting in asymmetric output force. The present invention, by providing asymmetric nonlinear differential hydraulic force feedback, is able to compensate for the asymmetry caused by the difference in exposed surface areas. In this example the orifice 50 used in fluid passageway 46' has a larger aperture than the orifice 48 used in fluid passageway 44'. Thus, orifice 50 provides a lesser impedance to fluid flow through passageway 46' as compared to orifice 48 and the fluid flow through passageway 44'. Consequently, a larger restoring force is provided to spool 16 during the extension stroke than the retraction stroke through the algebraic summing of the control signals and the feedback signals. With the selection of appropriate hydraulic force feedback impedance values as a function of the ratio of the exposed surface areas of the opposite faces 63, 65 of the actuator piston 66, stroke forces may be equalized.

EXAMPLE 2

The force asymmetry may be caused by an asymmetrical loading of the force servo actuator. In an NVH testing machine, which is oriented to move in a vertical axis and which supports a heavy load, a load asymmetry is caused by the force of gravity on the load. The gravitational force on the load increases pressure on the bottom side of the actuator piston in the quiescent state when the load is supported by hydraulic fluid. The present invention is able to compensate for the asymmetry caused by the differing load forces. Now referring to FIG. 1 for explanation, and supposing that the force servo actuator 58 is supporting a heavy load for movement in a vertical axis, the orifice 48 used in fluid passageway 44' has a larger aperture than the orifice 50 used in fluid passageway 46'. Thus, orifice 48 provides a lesser impedance to fluid flow through passageway 44' as compared to orifice 50 and the fluid flow through passageway 46'. Consequently, compensating forces are provided to spool 16 through the algebraic summing of the control signals and the feedback signals. With the selection of appropriate hydraulic force feedback impedance values as a function of the ratio of the known or postulated loading forces, actuator forces may be equalized.

EXAMPLE 3

The force asymmetry may be due to the actuator driving a nonlinear load where the mechanical advantage changes with actuator extension, such as in the case of a linear to rotary translation stage. The present invention is able to compensate for the asymmetry caused by the changing mechanical advantage. With the selection of appropriate feedback hydraulic force impedance values as a function of the ratio of the known or postulated changes in mechanical advantage, compensating forces are provided to spool 16.

The foregoing examples are merely illustrative in nature and are fairly simple for explanatory purposes. It should be understood, however, that the present invention encompasses compensating for one or combinations of more than one known or postulated force asymmetry at work in a specific application. The invention in its broadest sense also encompasses the purposeful control or management of force asymmetries to achieve desired objectives which may not include the complete cancellation or full compensation of the asymmetry. The invention also contemplates purposefully providing an asymmetry in an otherwise symmetric servo control system should the asymmetry achieve a desired goal.

A damping orifice 52 may be installed between first and second fluid passageways 44' and 46' for known purposes.

The orifices may be obtained commercially from, for example, The Lee Company of Westbrook, Conn. An alternate source may be Bird Precision of Waltham, Mass. The Lee Company makes orifices of a more complicated design with multiple staged orifices, which approximate simple orifices. This discussion will consider all orifices to be simple for the sake of clarity. Preferably, the apertures of orifices 48 and 50 may lie in the range of about 0.004 inch to 0.028 inch in diameter. Diameters of the two orifices are unequal for reasons explained earlier. The aperture of damping orifice 52 may range from zero (a solid plug) to about 0.059 inch in diameter. In general, the larger orifices are used for high flow three-stage servovalves capable of supplying more than 100 gallons per minute. Two stage servovalves with flow rates on the order of 5 gallons per minute may employ smaller sizes. As used herein the phrase "hydraulic force feedback impedance value" refers generally to the ability to physically impede a fluid flow and is not limited to any particular denomination.

Attempts to analytically establish precise optimal orifice aperture sizes have been only partially successful. An order of magnitude can be established, perhaps not exact optimal numbers. The reason appears to be related to the nonlinear nature of hydraulic systems and the fact that some of the parameters relating to fluid flow inside the passageways of a servovalve and actuator such as the Reynolds Number are difficult to measure, and they vary with the load. Accordingly, quantitative design of the orifice aperture sizes and ratio may readily be determined empirically.

As an alternative to the use of replaceable orifices 48, 50 and 52, variable orifices, such as pin or needle valves, might be used for any or all of the three orifices. The use of variable orifices makes empirical set-up of feedback impedances easier and faster. Commercially available needle valves and micrometer needle valves are known to be an acceptable substitute. As used herein and in the claims the term "orifice" includes not only a separable physical object having an aperture therethrough, but also an aperture or passageway which functions by itself to provide an impedance to fluid flow. For example, and with reference to FIG. 1, it is within the scope of the invention that fluid passageways 44–44' and 46–46' are constructed of differing diameters to take into account a known or postulated force asymmetry without requiring the use of a physically separable object for impedance. It is preferred for convenience of manufacture, however, that the fluid passageways 44–44' and 46–46' be of a common diameter. It is also preferred to use "knife edge" orifices, so the system will be less sensitive to fluid viscosity changes with temperature.

Fortunately and importantly, the feedback method includes nonlinearities similar to those in the servovalve. The feedback itself helps compensate and cancel the nonlinearities in the servovalve and actuator. Even a linear feedback system helps cancel those nonlinearities, but existing technology for designing such a linear feedback system has limitations in closed loop bandwidth and in ability to accurately compensate for nonlinearities. The nonlinear feedback method of this invention offers much improved closed loop bandwidth and greatly improved ability to compensate the nonlinearities of a servovalve, actuator, and load.

Figure 2:
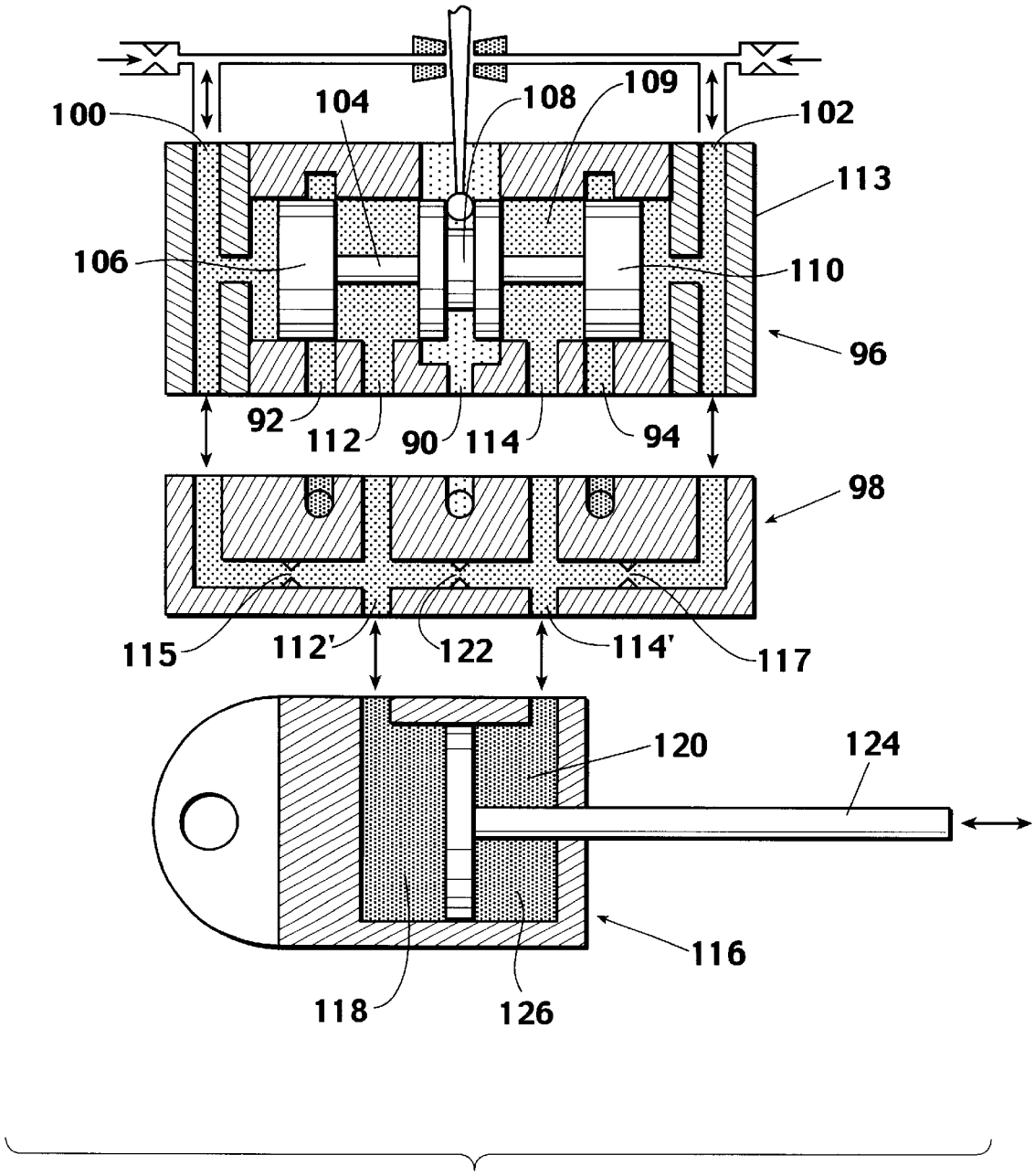
FIG. 2 is a schematic showing of a two-stage four-way servovalve in a hydraulic servo control system including a flapper nozzle hydro-amplifier, a main valve stage, a manifold, and an actuator piston with asymmetry in the areas of its two piston faces.

The arrangement of FIG. 1 provides asymmetric nonlinear differential hydraulic force feedback for a servovalve having a centrally located high pressure hydraulic fluid supply port and laterally bifurcated low pressure hydraulic fluid return ports as in the final stage of a multistage servovalve system. FIG. 2 shows an alternate arrangement that may be used with the output stage of a two-stage servovalve that employs a centrally located low pressure hydraulic fluid return port 90 and laterally bifurcated high pressure hydraulic fluid supply ports 92, 94. A valve body, generally shown as 96, includes hydraulic control signal input ports 100 and 102. Spool 104, shown in the neutral position in FIG. 2, having lands 106, 108 and 110, is slidingly mounted in a bore 109 in valve body 96. Bore 109 is closed at each end by end caps 111 and 113. The output pressure ports are shown as 112 and 114. A manifold 98 provides negative feedback passageways and receptacles for feedback orifices 115 and 117. Through-passages 112' and 114' provide fluid flow to chambers 118 and 120 of actuator 116 which includes a single-rod piston 126 and piston rod 124.

In a simplified operational example, control pressure applied over the line 100 urges the spool 104 to the right, exposing port 114 to high pressure port 94 and causing outward pressurized fluid flow, and exposing port 112 to low pressure return port 90, causing inward fluid flow. This tends to cause a pressure increase in actuator chamber 120 and a pressure decrease in actuator chamber 118. Load force acting on piston rod 124 is proportionally reflected in the pressure in actuator chamber 120 and is fed back through orifice 117 to the outside end of valve spool piston 110. This force tends to restore spool 104 to its neutral position. Orifice 122 is a damping orifice to moderate responsiveness and insure stability. Damping orifice 122 also offers the advantage of immediately damping pressure spikes such as those which may occur when piston rod 124 impacts a massive object. Damping these pressure spikes may reduce damage to the actuator and to the structure upon which the actuator is mounted, and may also reduce fluid cavitation in the actuator, a phenomenon well known to those skilled in the art as a common destructive phenomenon.

Figure 3:
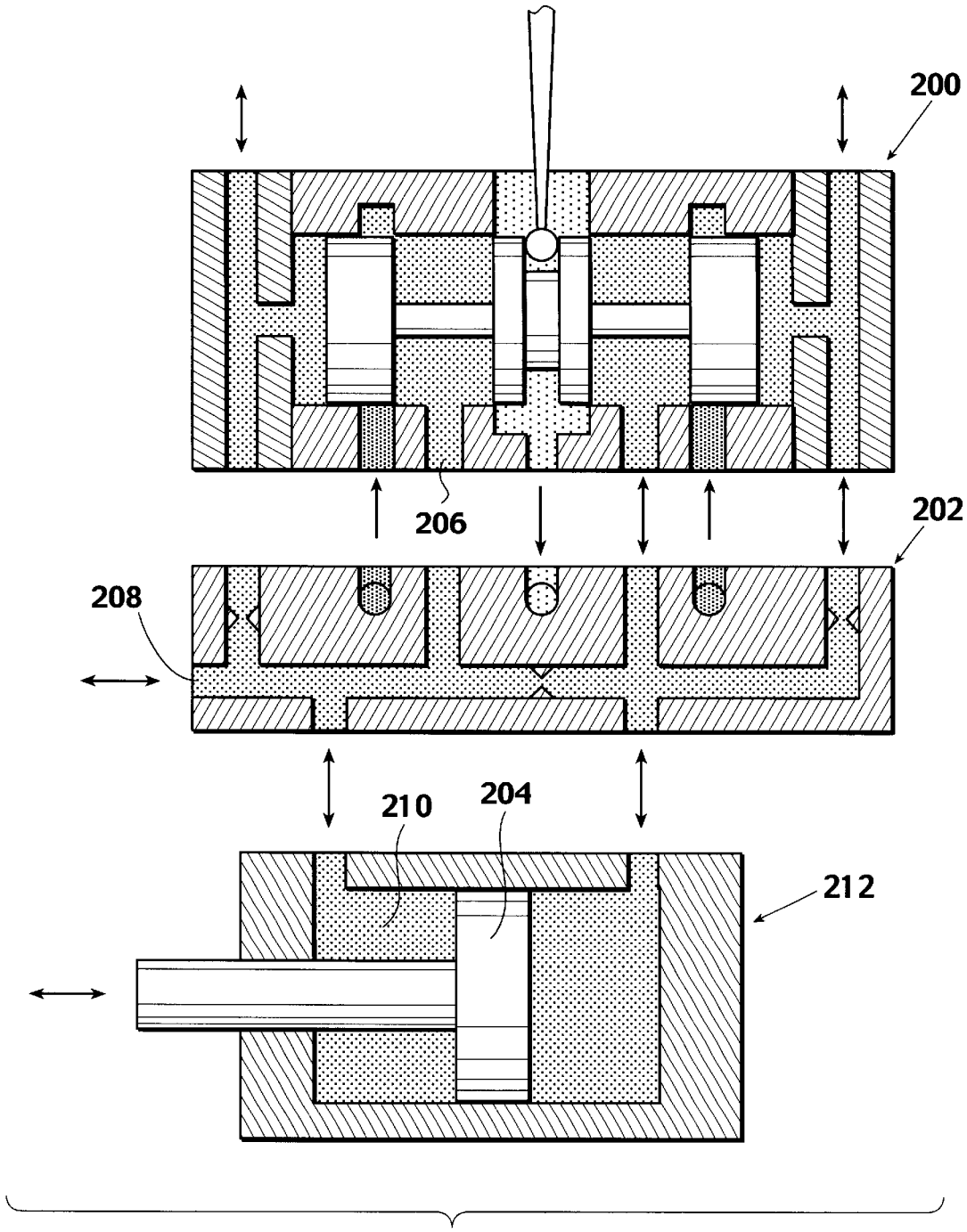
FIG. 3 is a schematic showing of a two-stage three-way servovalve application in a hydraulic servo control system including a four-way main valve stage, a manifold, and an actuator piston with asymmetry in the areas of its two piston faces.

FIG. 3 illustrates an exemplar two-stage three-way servovalve application in a hydraulic system including a main valve stage 200, a manifold 202, and an actuator piston 204 with asymmetry in the areas of its two piston faces. In this example, a common four-way valve is used as a three-way valve by blocking outlet port 206 at the manifold 202. Outlet port 206 is replaced by a direct connection 208 from one chamber 210 of the actuator 212 to a fluid port such as a low pressure return port. Alternatively, one actuator chamber may be dry, or may be filled with another fluid or gas such as compressed nitrogen. In such an arrangement as illustrated, the invention would offer only single-ended nonlinear hydraulic force feedback rather than differential. Single-ended feedback is by nature, asymmetric.

For simplicity, the operation of this invention was explained in terms of single-ended hydraulic force feedback. In actual use, employing differential hydraulic force feedback, the system senses net load force which may be either corrected for or tempered by asymmetry, and performs very rapid compensation for a load disturbance in either direction. Thus, if the load is expected to be resisting force in one direction and a shock is impulsively applied from the other direction, the differential hydraulic force thereby will sense both the magnitude and polarity of the disturbance and cause the system to instantly compensate. The system monitors the pressure on both sides of the actuator piston simultaneously so that hydraulic force feedback is applied to both ends of the valve spool with the end having the higher pressure dominating, and algebraically summing with the control signal pressure. The effect of the pressure feedback is nonlinearly related to the pressure difference across the actuator piston in dynamic operation, and linearly related in the static condition. The nonlinearity arises from a square root term in the relationship of fluid flow through an orifice to the pressure across the orifice.

It is to be understood that the teachings of this invention may be applied to the input and the output side of the main stage of a servovalve having any number of stages. The servo system may include a linear or a rotary actuator. If linear, the actuator may include a single rod or a double rod piston. The servovalve may be either a three-way valve or a four-way valve. The teachings apply to use with pilot valves of the flapper-nozzle type and of the jet pipe type (not shown).

While the invention has been described with a certain degree of particularity, it is understood that the invention is not limited to the embodiment(s) set forth herein for purposes of exemplification, but is to be limited only by the scope of the attached claim or claims, including the full range of equivalency to which each element thereof is entitled.

What is claimed is:

1. A hydraulic servo control system, comprising in combination:

a force servo actuator of the type having an actuator piston mounted in a dual-chamber actuator cylinder for bi-directionally moving a load in oppositely directed strokes;

a force servovalve operatively connected to the force servo actuator, the servovalve including a spool valve of the type wherein its position along its axis is controlled by volumes of fluid in first and second opposed control signal input ports, the spool valve having at least one inlet port for receiving a flow of pressurized fluid, at least one return port, and first and second outlet ports for delivering pressurized fluid to respective chambers of the dual-chamber actuator cylinder; and hydraulic means for controlling a force asymmetry acting upon the force servo actuator, characterized by:

a first fluid passageway for providing negative nonlinear hydraulic force feedback communication between the first outlet port and the second control signal input port;

a second fluid passageway for providing negative nonlinear hydraulic force feedback communication between the second outlet port and the first control signal input port;

a first orifice in the first fluid passageway having a first preselected hydraulic force feedback impedance value;

a second orifice in the second fluid passageway having a second preselected hydraulic force feedback impedance value;

wherein the first and second preselected hydraulic force feedback impedance values are unequal and wherein the values are a function of the known or postulated force asymmetry acting upon the actuator.

2. The servo control system according to claim 1, wherein the actuator piston has opposite faces of differing exposed surface areas causing the force asymmetry and wherein the preselected hydraulic force feedback impedance values are a function of the ratio of the exposed surface areas of the opposite faces of the actuator piston.

3. The servo control system according to claim 2, wherein the orifice in fluid communication with the chamber having the piston face with the higher exposed surface area has a preselected hydraulic force feedback impedance value less than that of the other orifice.

4. The servo control system according to claim 1, wherein the force asymmetry arises from an asymmetrical loading of the force servo actuator and wherein the preselected hydraulic force feedback impedance values are a function of the ratio of load forces applied to the opposite faces of the actuator piston during the oppositely directed strokes.

5. The servo control system according to claim 4, wherein the force asymmetry arises from the driving of a nonlinear load.

6. The servo control system according to claim 1, wherein the first and second orifices lie in the range of about 0.004 inch to 0.028 inch in diameter.

7. The servo control system according to claim 1, wherein the servovalve is further characterized by having a central return port and a pair of laterally bifurcated high pressure ports.

8. The servo control system according to claim 1, wherein the servovalve is further characterized by having a central high pressure port and two laterally bifurcated return ports.

9. The servo control system according to claim 1, further comprising a damping orifice means fluidly interconnecting the first and second fluid passageways.

10. A hydraulic servo control system, comprising in combination:

a force servo actuator of the type having an actuator piston mounted in a dual-chamber actuator cylinder for bi-directionally moving a load in oppositely directed strokes;

a force servovalve operatively connected to the force servo actuator, the servovalve including a spool valve of the type wherein its position along its axis is controlled by volumes of fluid in two opposed control signal input ports, the spool valve having at least one inlet port for receiving a flow of pressurized fluid, at least one return port, and at least one outlet port for delivering pressurized fluid to the dual chamber actuator cylinder; and hydraulic means for compensating for a force asymmetry acting upon the force servo actuator, characterized by:

at least one fluid passageway for providing negative nonlinear hydraulic force feedback communication between at least one outlet port and one of the control signal input ports; and an orifice in the fluid passageway having a preselected hydraulic force feedback impedance, wherein the preselected impedance is a function of the known or postulated force asymmetry acting upon the actuator and is of a value unequal to the value of other orifices in other fluid passageways, if any.

* * * * *